US005838292A

United States Patent [19]

Lockmuller

[11] Patent Number: 5,838,292

[45] Date of Patent: Nov. 17, 1998

[54] TEMPERATURE COMPENSATION IN GREYSCALE ADDRESSING

[75] Inventor: Neil Lockmuller, Hayes, United Kingdom

[73] Assignee: Central Research Laboratories, Ltd., England

[21] Appl. No.: 640,964

[22] PCT Filed: Nov. 8, 1994

[86] PCT No.: PCT/GB94/02444

§ 371 Date: May 9, 1996

§ 102(e) Date: May 9, 1996

[87] PCT Pub. No.: WO95/13602

PCT Pub. Date: May 18, 1995

[30] Foreign Application Priority Data

Nov. 11, 1993 [GB] United Kingdom ..... 9323242

[51] Int. Cl.[6] ..... G09G 3/36

[52] U.S. Cl. ..... 345/97; 345/87; 345/94; 345/99; 345/101

[58] Field of Search ..... 345/87, 94, 95, 345/97, 99, 101

[56] References Cited

FOREIGN PATENT DOCUMENTS 0 240 010 7/1987 European Pat. Off. .
0-453856 10/1991 European Pat. Off. .
0-545400 9/1993 European Pat. Off. .

*Primary Examiner*—Richard A. Hjerpe
*Assistant Examiner*—Kent Chang
*Attorney, Agent, or Firm*—Evenson, McKeown, Edwards & Lenahan, P.L.L.C.

[57] ABSTRACT

In a method for addressing an array of pixels contained, for example, in a liquid crystal display device, the liquid crystal material is switched from a first stable state to a second stable state by applying a voltage of one polarity and a given duration between electrodes on opposite sides of the pixel. Likewise, the liquid crystal material is switched from the second stable state to the first stable state by applying a voltage of an opposite polarity and given duration between the electrodes, the magnitude of the voltage required between the electrodes to switch from either stable state to the other stable state being subject to different thresholds for different parts of the total area layer. To eliminate the effect of temperature induced variations in the switching threshold of the material, according to the invention after the application of the second voltage, a third voltage is applied between the electrodes, which has a polarity, magnitude and duration which insure that, at the given temperature, the pixel is switched back by the third voltage to the second stable state, over only a part of the portion of the total area over which the pixel was switched to the first stable state by the second voltage. The efficacy of the method according to the invention is further enhanced by the application of fourth and fifth voltages which just fail to insure that the optical state is switched.

4 Claims, 4 Drawing Sheets

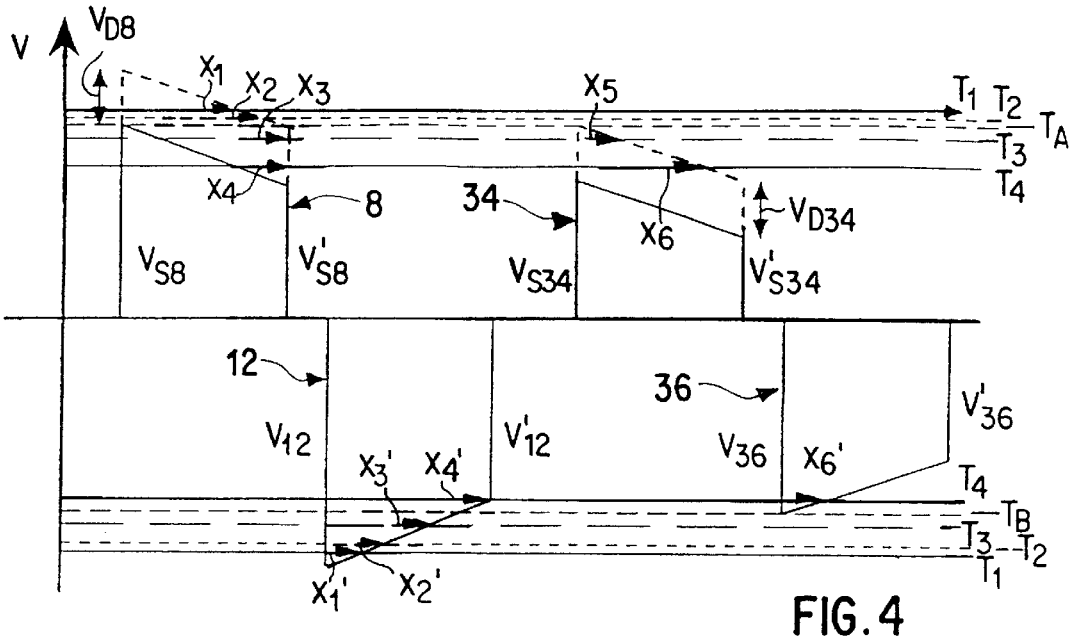
FIG. 4
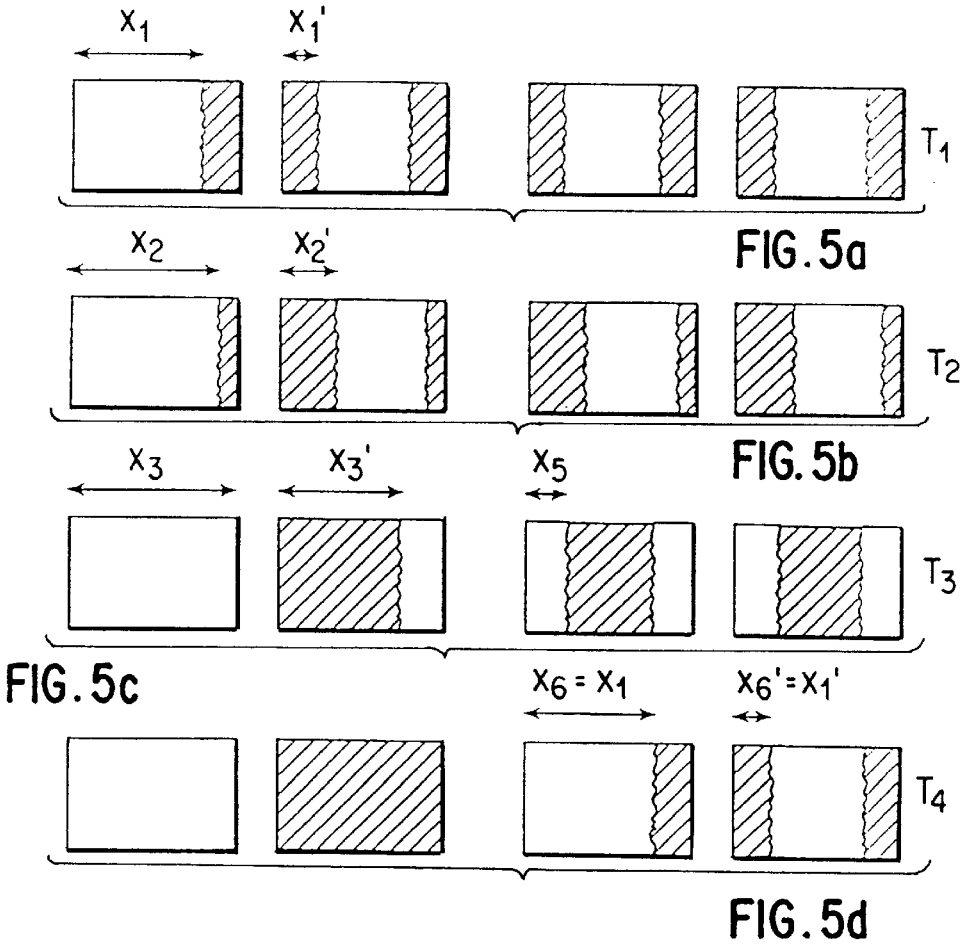

TEMPERATURE COMPENSATION IN GREYSCALE ADDRESSING

This invention relates to a method of addressing an optical cell which comprises a layer of material sandwiched between a pair of electrodes, the material having an optical property which is switchable from a first stable state to a second stable state by applying a voltage of one polarity and a given duration between the electrodes and from, the second stable state to the first stable state by applying a voltage of the other polarity and the given duration between the electrodes, the magnitude of the voltage required between the electrodes to switch the optical property from either stable state to the other stable state being subject to different thresholds for different parts of the total area of the layer, which thresholds vary with temperature, in which method a first voltage is applied between the electrodes, the first voltage having the one polarity and a magnitude and duration which are appropriate to ensure that the optical property attains the second stable state over the total area of the layer, after which a second voltage is applied between the electrodes, the second voltage having the other polarity and a magnitude and duration which are appropriate to ensure that, at a given temperature, the optical property is switched by the second voltage from the second stable state to the first stable state over only a portion of the total area of the layer.

A method of the above general kind is disclosed, for example, in EP-A-0240010.

Cells containing material which is electrically addressable to change its optical property, for example between a light-transmissive state and a non light-transmissive state, are commonly proposed for use in displays or printer applications. An array of such cells may be formed, for example, by means of a pair of transparent substrates sandwiching a layer of ferroelectric liquid crystal material between them, and each carrying a set of transparent electrodes oriented so as to cross each other to define a matrix of pixels. In such a case each pixel can be addressed by applying an electrical signal to the corresponding member of each set of electrodes.

Pixels with varying switching thresholds over their areas may be formed, for example, with one or both sets of electrodes having varying thicknesses across their width so that an applied voltage between overlapping electrodes produces differing electric fields across the width of the pixel, which may be sufficient to cause switching of the material in some areas but not in others. As an alternative they may be formed, for example, using an alignment control layer which has different alignment control powers at different regions over the area of each pixel. Both of these possibilities are disclosed in the aforementioned EP-A-0240010. The variation is preferably continuous; if the variation has a stepped form the steps are preferably small and many in number.

A problem with prior art methods of addressing such matrices is that the switching threshold of the material may vary with temperature, so that for a given applied voltage, as the temperature varies so does the amount of the pixel which switches, and thus the brightness level or grey level obtained.

It is an object of the present invention to alleviate this problem of the known prior art.

According to the present invention, a method as defined in the first paragraph is characterised in that, after the application of the second voltage, a third voltage is applied between the electrodes, the third voltage having the one polarity and a magnitude and duration which are appropriate to ensure that, at the given temperature, the optical property is switched back by the third voltage to the second stable state over only a portion of that portion of the total area of the layer over which the optical property has been switched to the first stable state by the second voltage.

The switchings by the second and third voltages may have substantially the same temperature dependance, so that the amount of variation of the brightness level with temperature can be reduced.

If the second voltage has a magnitude and duration which, at a first further temperature different from the given temperature, are appropriate to just ensure that the optical property is switched by the second voltage from the second stable state to the first stable state over the total area of the layer, an increase in the temperature range over which a reduction in brightness level variation with temperature can be obtained may be achieved by arranging that, after the application of the third voltage, a fourth voltage is applied between the electrodes, the fourth voltage having the other polarity and a magnitude and duration which are appropriate to just fail to ensure that, at the first further temperature, the optical property is switched by the fourth voltage from the second stable state to the first stable state over any portion of the total area of the layer.

In such a case, if the third voltage has a magnitude and duration which, at a second further temperature different from the given temperature and the first further temperature, are appropriate to just ensure that the optical property is switched back by the third voltage to the second stable state over the total area of the layer, a further increase in the temperature range may be achieved by arranging that, after the application of the fourth voltage, a fifth voltage is applied between the electrodes, the fifth voltage having the one polarity and a magnitude and duration which are appropriate to just fail to ensure that, at the second further temperature, the optical property is switched by the fifth voltage from the first stable state to the second stable state over any portion of the total area of the layer.

The material may be ferroelectric liquid crystal material.

In order that the present invention may be more readily understood, reference will now be made, by way of example, to the accompanying diagrammatic drawings, in which.

Figure 3A:
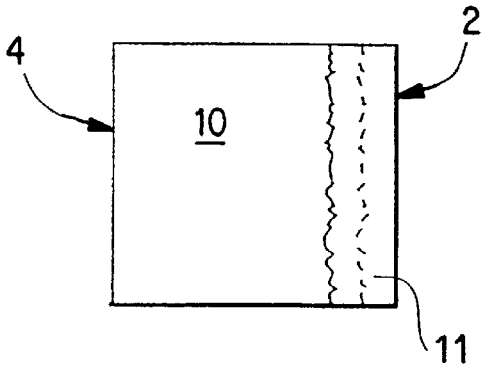
Figure 3B:
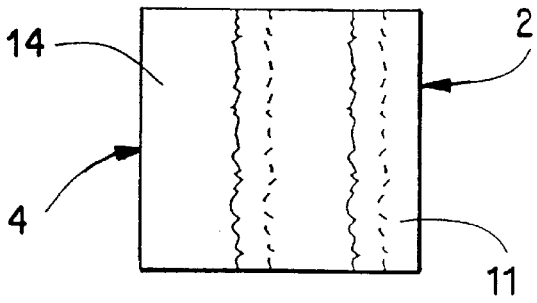
Figure 6:
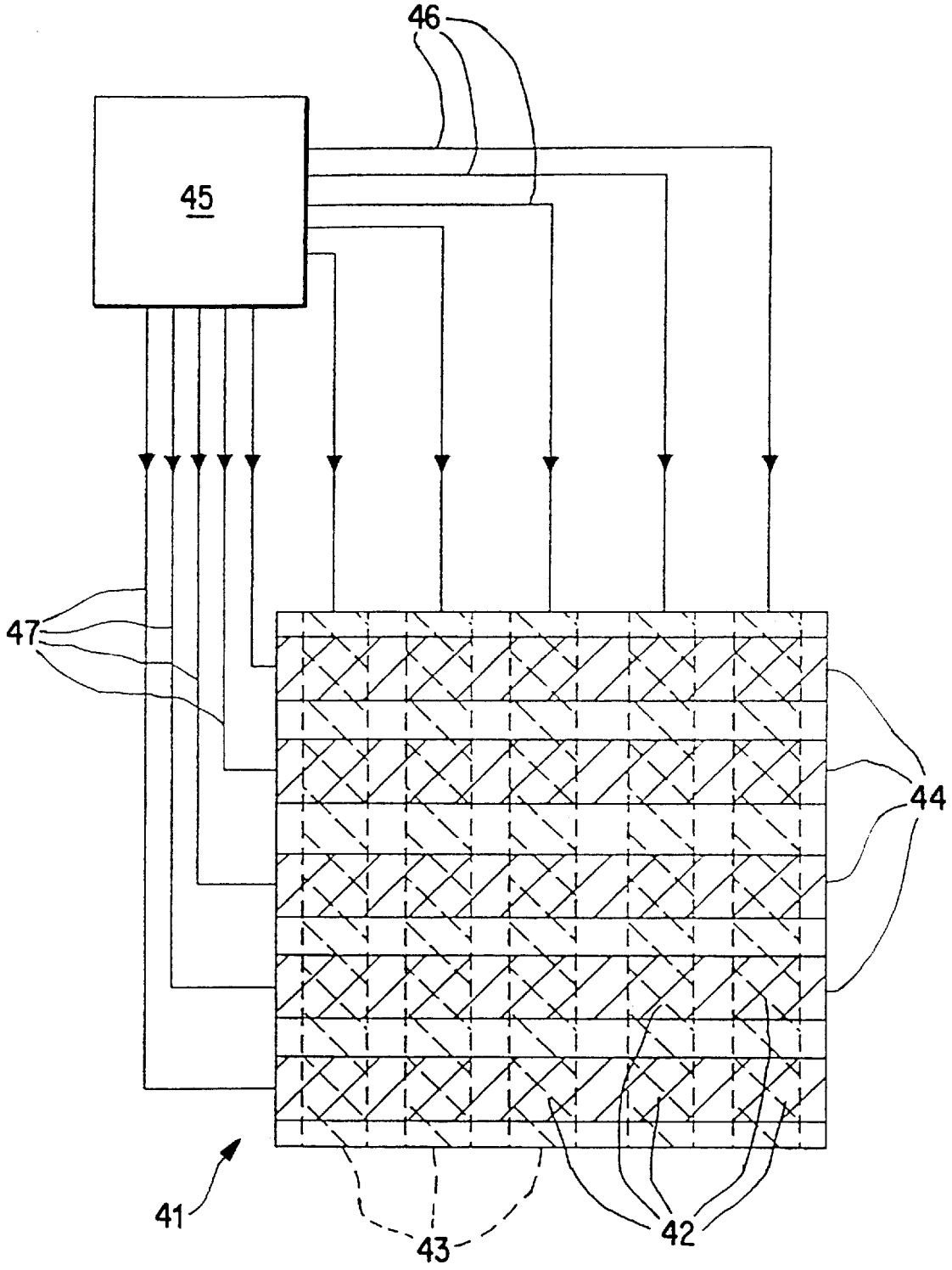
Figure 7:
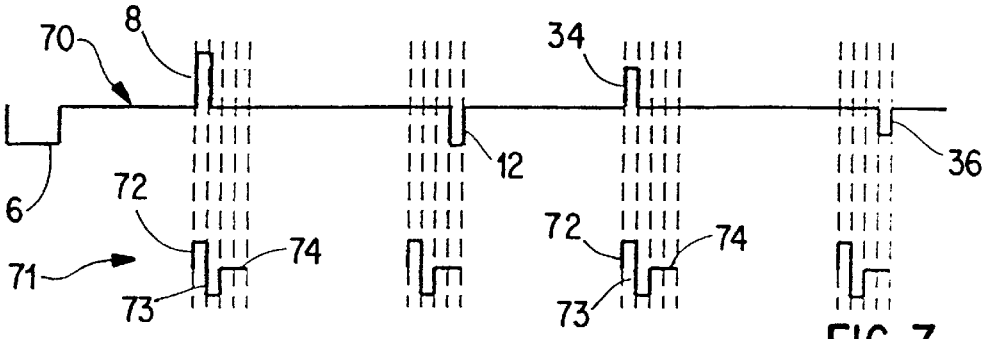
Figure 8:
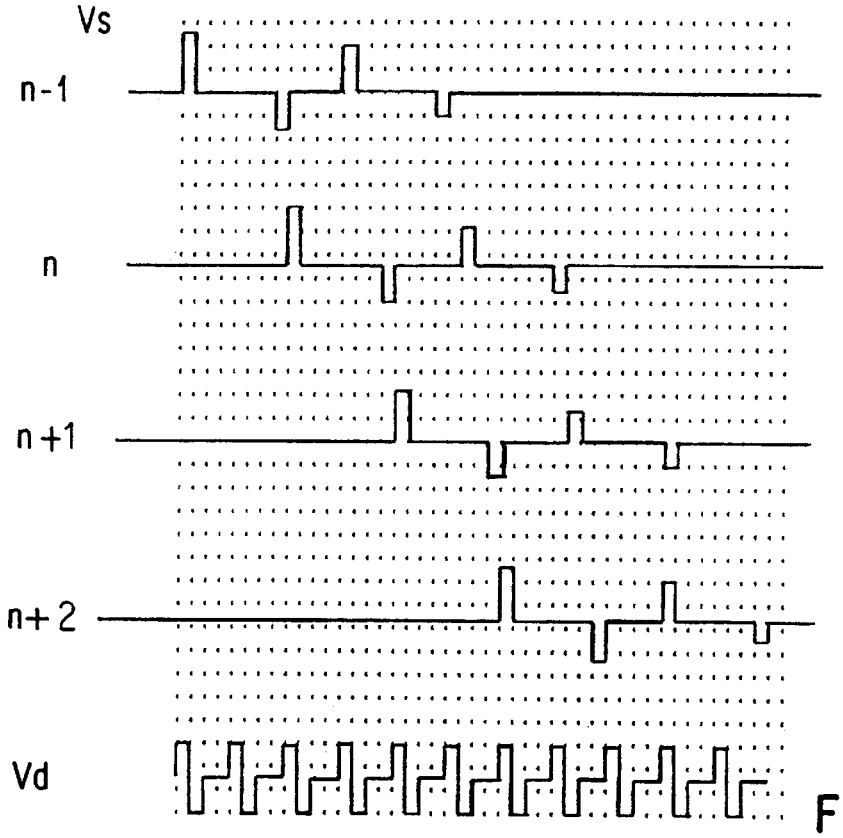
Figure 9:
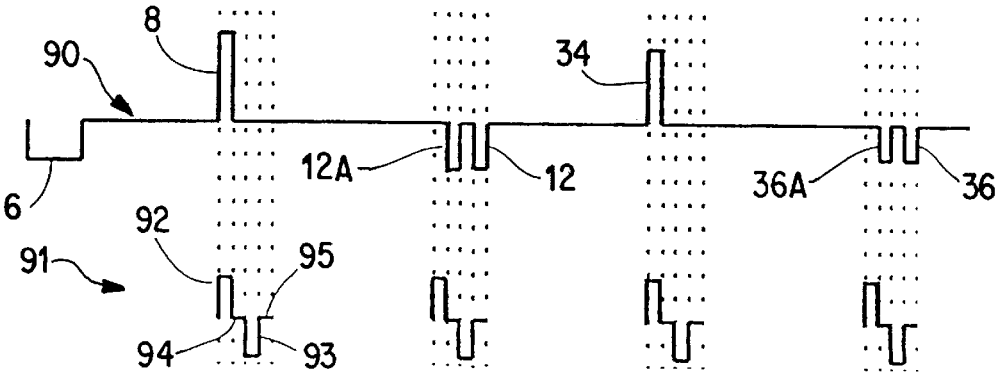

FIG. 3*a* is a plan view of the cell after the second voltage has been applied, for two different temperatures;

FIG. 3*b* shows the cell after the third voltage has been applied;

FIG. 4 is a graph showing the electric field experienced across the material of a cell for four different voltage pulses in another embodiment of the invention;

FIG. 5 shows plan views of the cell after each pulse in FIG. 4 has been applied, for four different temperatures;

FIG. 6 shows a matrix of cells together with addressing means therefor;

FIG. 7 shows signals which may be produced by the addressing means of FIG. 6;

FIG. 8 also shows signals which may be produced by the addressing means of FIG. 6; and FIG. 9 shows signals which may replace the signals of FIG. 6.

Figure 1:
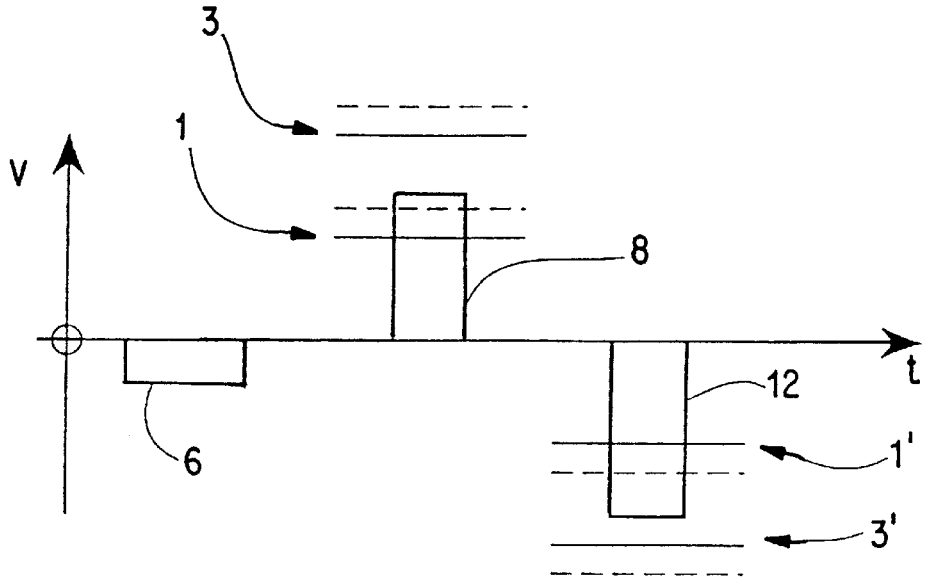
FIG. 1 shows the pulses applied during one addressing of a cell in to one embodiment of the invention.
Figure 2:
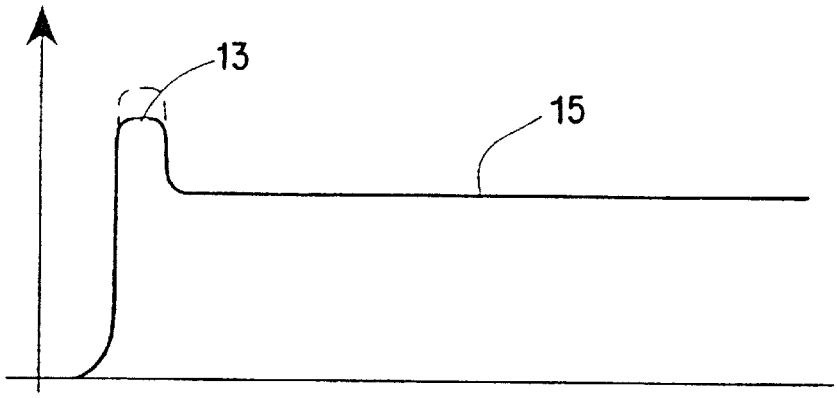
FIG. 2 is graph showing light transmission against time for the cell throughout the addressing period for two different temperatures.

Referring to FIGS. 1 and 2, an optical cell (not shown) comprising a layer of ferroelectric liquid crystal material sandwiched between a pair of electrodes, which cell is constructed in such manner that the magnitude of the voltage V required to switch the material from one of its stable optical states to the other, when this voltage has a given duration, is subject to different thresholds for different parts of the total area of the layer, is addressed by applying three voltage pulses 6, 8 and 12 respectively between the electrodes in succession. The pulses 6 and 12 have one polarity and the pulse 8 has the other polarity. This example shows the inverse mode of operation, where switching from, one stable state to the other occurs below a threshold voltage level, and does not occur above that threshold level. The switching threshold, given a voltage pulse of a certain width, varies across the cell from a first level 1,1' at one edge of the pixel (2 in FIGS. 3*a* and *b*) to a greater second level 3,3' at the other end (4 in FIGS. 3*a* and *b*). The first pulse 6 sets the whole of the ferroelectric material of the cell to its second stable optical state (which may correspond to a dark or non light-transmissive state of a pixel of which the cell may form a component if it is situated, for example, between crossed polarisers). The second pulse 8, the voltage level of which lies between the respective switching thresholds 1, 3 at the edges 2, 4 of the cell, then sets to its first stable optical state a part 10 of the liquid crystal layer adjacent the other end 4, whilst leaving a part 11 at the one end 2 unswitched. (The first stable state may correspond to the light or light-transmissive state of the aforementioned pixel).

When the third pulse 12 of the opposite polarity to the second is applied, the voltage level of this pulse also lying between the respective switching thresholds 1', 3' at the edges 2, 4 of the pixel, a portion 14 of the switched part 10 of the layer is switched back to the second state whilst the part adjacent the edge 2 is unaffected.

In the example it is required to switch half of a pixel of which the cell forms part to the light-transmissive state. The second voltage pulse 8 exceeds the switching threshold of about a quarter of the width of the pixel, so that this part remains in the dark state whilst three quarters of the pixel switches to the light-transmissive state. The third pulse 12 is applied shortly thereafter, and exceeds the switching threshold of three-quarters of the width of the pixel which is thus unaffected, whilst one quarter switches back to the dark state. Therefore the brightness level 15 achieved is half of the total possible brightness level.

Should the temperature rise, the switching threshold of the material over the entire width of the pixel becomes greater; that is, more positive or more negative, as shown in broken lines in FIG. 1. Thus the second voltage pulse 8 causes a greater part 10 of the pixel to switch to the light state whilst the third voltage pulse 12 causes a greater portion 14 of that part to switch back to the dark state, as shown in broken lines in FIGS. 3*a* and *b*. It can be seen that, whilst the brightness level 13 after the second voltage pulse changes with temperature as shown in broken lines in FIG. 2, the third voltage pulse compensates for this change, and the resulting level 15 may be the same, as shown in FIGS. 2 and 3*b*.

It will be evident that other brightness levels may be obtained by appropriately choosing the magnitude of the pulse 8 and/or 12.

Consideration of FIG. 1 reveals that, should the temperature rise still further, the threshold 1 may eventually coincide with or even lie above the top of the pulse 8, with the result that the pulse 8 will switch the whole of the pixel to the light-transmissive state. Compensation for any change in threshold will not occur when this situation is present unless further steps are taken. A possible such further step will now be described with reference to FIG. 4.

As shown in FIG. 4, the third voltage pulse 12 may be followed by a fourth voltage pulse 34, of the same polarity as the second pulse 8, applied between the electrodes of the cell. Moreover, if desired, the fourth pulse 34 may be followed by a fifth voltage pulse 36 of the same polarity as the third pulse 12, also applied between the electrodes of the cell.

In FIG. 4 the sloping top of each voltage pulse 8, 12, 34, 36 is not intended to indicate that the magnitude of the pulse decreases with time (as this is not the case) but rather represents the effective electric field experienced by the ferroelectric liquid crystal material from one edge of the cell to the other during the application of the relevant voltage pulse thereto. This example shows the 'normal mode' of operation of switching the material; that is operation in a voltage range in which a low voltage does not cause switching whilst a higher voltage does cause switching. The lines $T_1$ to $T_4$ represent the switching threshold of the material at increasing temperatures for the pulse widths shown, and relate also to FIG. 5. The lines $T_A$ and $T_B$ represent the switching threshold of the material at particular temperatures within this range and will be referred to below.

After blanking with a first voltage pulse (not shown) as before and the application of second and third voltage pulses 8 and 12 as before, fourth and fifth voltage pulses 34 and 36 are applied across the electrodes of the cell. In this example the second and fourth voltage pulses 8 and 34 are constituted by fixed-magnitude voltage pulses $V_{SS}$ and $V_{S34}$ respectively applied to one electrode of the cell combined with variable-magnitude but mutually equal data voltage pulses $V_{DS}$ and $V_{D34}$ respectively applied to the other electrode of the cell. The third and fifth voltage pulses 12 and 36 have fixed magnitudes.

It will be seen that the lowest electric field experienced by any part of the material of the cell due to the application of the pulse 8 coincides with the threshold line $T_A$, as does the highest electric field experienced by any part of the material of the cell due to the application of the pulse 34. Similarly the lowest electric field experienced by any part of the material of the cell due to the application of the pulse 12 coincides with the threshold line $T_B$, as does the highest electric field experienced by any part of the material of the cell due to the application of the pulse 36. Thus, at the temperature at which the threshold $T_A$ is applicable, the pulse 8 has a magnitude and duration which just ensure that the material of the cell is switched by the pulse over the whole of its area to an optical state corresponding to a a bright or light—transmissive state of a pixel of which the cell forms part, and the pulse 34 has a magnitude and duration which just fail to ensure that the material of the cell is switched by the pulse over any portion of its area to this optical state. Similarly, at the temperature at which the threshold $T_B$ is applicable, the pulse 12 has a magnitude and duration which just ensure that the material of the cell is switched by the pulse over the whole of its area to an optical state corresponding to a dark or light non-tansmissive state of the pixel, and the pulse 36 has a magnitude and duration which just fail to ensure that the material of the cell is switched by the pulse over any portion of its area to this optical state.

Referring also to FIG. 5 it can be seen that when, for example, a brightness level of one half of the possible brightness is required, at temperatures at which the thresholds $T_1$ and $T_2$ apply the second and third pulses 8, 12 have an effect similar to that already described, and the fourth and fifth pulses 34, 36 do not have any effect since the electric field experienced by any part of the ferroelectric material due to these pulses lies entirely below the switching threshold. At a higher temperature at which the threshold $T_3$, applies, the second pulse 8 lies entirely above the switching threshold and therefore switches the entire pixel. At this temperature, part of the fourth pulse 34 lies above the threshold so that a part $x_5$ of the pixel is switched by this pulse. In the same way, at a still higher temperature $T_4$, the third pulse 12 switches the entire pixel by lying entirely above the threshold. At this temperature the fifth pulse 36 come into effect to switch a part $x_6$ of the pixel.

In this manner, the fourth and fifth pulses 'take over' from the second and third pulses when the temperature is such that the latter cease to have a brightness controlling effect.

It will be appreciated that still further pulses of alternating polarity similar to the pulses 34 and 36 and each having the same properties relative to the immediately preceding pulse of the same polarity as do the pulses 34 and 36 to the pulses 8 and 12 respectively could be applied to the cell to enable a still broader temperature range to be accommodated, if desired.

Although as described the brightness ultily achieved is controlled by meaIs of variable componenets $V_{D8}$ and $V_{D34}$ superimposed on the fixed components $V_{S8}$ and $V_{S34}$ of the pulses 8 and 34 respectively, brightness control may alternatively be achieved by means of variable components superimposed on the fixed components of the pulses 12 and 36. A further possibility is to superimpose variable components on the fixed components of the pulses 12 and 36 in addition to the variable components superimposed on the fixed components of the pulses 8 and 34, the variable componenets of the pulses 12 and 36 then bearing a predetermined relationship to the variable components of the pulses 8 and 34.

As mentioned previously, the example of FIGS. 4 and 5 relates to the "normal mode" of operation of switching the material of the cell, i.e. operation in a voltage range in which a low voltage does not cause switching whereas a higher voltage does cause switching. For operation in the "inverse mode", in which the opposite is the case, the successive pulses of the same polarity, e.g. pulses 8 and 34 and pulses 12 and 36, should have increasing rather than decreasing magnitudes. Moreover the magnitude of the pulse 12 should then be greater than that of the pulse 8, and the magnitude of the pulse 36 should then be greater than the magnitude of the pulse 34.

Although as described with reference to FIGS. 4 and 5 control of the brightness, ultimately obtained is achieved by controlling the magnitudes of the pulses 8 and 34, and/or the magnitudes of the pulses 12 and 36, it will be appreciated that such control may alternatively or additionally be achieved by controlling the widths of these pulses.

The invention has been described so far in the context of addressing a single optical cell. As previously mentioned, an array of such cells may be formed, for example, by means of a pair of transparent substrates sandwiching a layer of ferroelectric liquid crystal material between them and each carrying a set of transparent electrodes oriented so as to cross each other to define a matrix of pixels. Some possible ways in which the cells of such a matrix may be addressed by a method in accordance with the invention will now be described.

FIG. 6 of the drawings shows such a matrix together with addressing means therefor in diagrammatic form More particularly it shows a matrix-type array 41 of liquid crystal cells comprising a pair of transparent plates which are superimposed one upon the other with a small spacing therebetween which contains ferroelectric liquid crystal material. The array comprises a plurality of picture elements (pixels) in the form of cells which are defined by areas 42 of overlap between members of a first set of parallel transparent electrodes 44 provided on the inner surface of one plate, i.e. on one side of the liquid crystal material, and members of a second set of parallel transparent electrodes 43 provided on the inner surface of the other plate, i.e. on the other side of the liquid crystal material. The electrodes 43 and the electrodes 44 cross each other and in the present example are oriented substantially orthogonal to each other and each corresponds to a respective line of pixels. (With the orientation shown each electrode 43 corresponds to a respective column of pixels and each electrode 44 corresponds to a respective row). As previously discussed with reference to a single cell, the array is constructed in such manner that the voltage required between the electrodes corresponding to each pixel to switch the ferroelectric material of that pixel from one stable state to the other is subject to different thresholds for different parts of the area of the pixel, which thresholds vary with temperature.

The array 41 is addressed by means of an addressing signal generator 45 via conductors 46 which are connected to respective electrodes 43 and conductors 47 which are connected to respective electrodes 44. For each pixel the resulting electric field applied thereacross determines the alignment of the liquid crystal molecules over the various parts of the pixel and hence the optical states of the various parts of that pixel. The array 41 is positioned between parallel or crossed polarizers (not shown). The orientation of the polarizers relative to the alignment of the liquid crystal molecules determines whether or not light can pass through a pixel when the ferroelectric material thereof is in a given state. Accordingly, for a given orientation of the polarizers, the various parts of each pixel each have a first and a second optically distinguishable state provided by the two stable states of the liquid crystal molecules included in the relevant part of that pixel.

The signals produced by generator 45 may be as shown in FIGS. 7 and 8.

FIG. 7 shows at 70 the complete waveform applied to each of the conductors 47 of FIG. 6 (although staggered in time from conductor to conductor) by the generator 45 in order to address the row of pixels 42 corresponding to that conductor. The vertical dashed lines signify successive time periods of equal length ("slots"). FIG. 7 moreover shows at 71 data waveforms which are applied in parallel to all the conductors 46 with the time relationships to the waveform 70 indicated. Each complete waveform 70 comprises, similarly to what has already been described with reference to FIGS. 1 and 4, first, second, third, fourth and fifth fixed-amplitude voltage pulses 6, 8, 12, 34 and 36 respectively. The pulse 6 sets each and every pixel on the corresponding row to the blanked state, whatever waveform 71 is simultaneously applied to the conductors 46. Each data waveform comprises a pulse 72 of one polarity, a given magnitude and a duration equal to one time slot, a pulse 73 of the other polarity, the given magnitude and a duration equal to one time slot, and a portion 74 of zero voltage and a duration equal to two time slots. The first and third of the data waveforms shown carry data for the pixels of the row to which the waveform 70 is applied whereas the second and fourth of the data waveforms shown carry data for pixels of another row or rows, as will become evident hereinafter. Although each of the data waveforms is shown as being identical this in fact will not normally be the case. Nor will it normally be the case that the data waveforms being applied in parallel at any given time to all the conductors 46 will be identical as each has to carry data for a respective pixel on the currently addressed row, and this data will not normally be the same for each pixel. Although not shown in the drawing the data carried by a given data waveform on a given conductor 46 is made variable by making the magnitude of its two voltage pulses 72 and 73 variable and also their polarities (although they will always be of equal magnitude and mutually opposite polarities in order to maintain so-called "charge balance"). It will be seen that the (fixed-amplitude) second and fourth pulses 8 and 34 of waveform 70 each coincide with the (variable magnitude and polarity) first pulse 72 of a respective data waveform so that the resulting voltages across the pixel at the intersection of the corresponding electrodes 43 and 44 are a combination of these pulses—c.f. the fixed component $V_S$ and the variable component $V_D$ of the pulses 8 and 34 in FIG. 4—, whereas the (fixed-amplitude) third and fifth pulses 12 and 36 of waveform 70 each coincide with the zero voltage portion 74 of a data waveform, so that the resulting voltages across the pixel at the intersection of the corresponding electrodes 43 and 44 are simply due to these fixed-aplitude pulses—c.f. the fixed-amplitude pulses 12 and 36 of FIG. 4.

FIG. 8 illustrates how the waveforms 70 applied by generator 45 to respective areas of the row conductors 47 of FIG. 6 may be related in time, both to each other and to successive data signals $V_d$ applied by generator 45 in parallel to the conductors 46. The blanking pulses 6 have not been shown in FIG. 8 for clarity's sake. The waveforms 70 applied to four successively addressed rows of pixels via respective ones of the conductors 47 are denoted by n−1, n, n+1 and n+2 respectively.

FIG. 9 shows a possible alternative to the waveforms 70 and 71 of FIG. 7. In FIG. 9 the waveforms 70 and 71 of FIG. 7 are replaced by the waveforms 90 and 91 respectively. The differences between the waveforms 70 and 90 is that, in waveform 90, a further voltage pulse 12A, equal in magnitude and duration to the voltage pulse 12, precedes the voltage pulse 12 at such a time that it is spaced from the pulse 12 by one time-slot, and a further voltage pulse 36A, equal in magnitude and duration to the voltage pulse 36, precedes the voltage pulse 36 at such a time that it is spaced from the pulse 36 by one time-slot. The data waveforms 91 each include two pulses 92 and 93 of opposite polarity similar to the pulses 72 and 73 of the waveforms 71 of FIG. 7. However the pulses 93 are spaced from the immediately preceding pulses 92 by one time-slot, rather than following them directly. Thus each of the pulses 12, 12A, 36 and 36A coincides with a zero, 94 or 95, in a data waveform 91.

If desired the time relationship between the waveforms 90 and 91 of FIG. 9 may be changed by shifting each of the pulses 12, 12A, 36 and 36A one time-slot forward in time. If this is done each of these pulses will coincide with a non-zero part of a data waveform 91. However one of the pulses of each pair 12, 12A and 36, 36A will coincide with a pulse 92 of a given data waveform whereas the other will coincide with the pulse 93 of the same waveform. As these two pulses 92 and 93 have the same magnitude but opposite polarities the average effect of these pulses on the pulse pair 12, 12A or 36, 36A will be negligible.

I claim:

1. A method of addressing an optical cell in an array of similar cells, the optical cell including a material disposed between first and second electrodes, which receive respective first and second voltage waveforms, the first waveforms having data-carrying portions, and the second waveforms having strobing portions; the material being capable of assuming a first condition or a second condition in response to switching voltages developed across said optical cell by coincident application of said voltage waveforms to said electrodes, said first and second conditions being stable and optically distinguishable from one another; the first waveform comprising a repeated waveform sequence, each sequence occupying a plurality of time-slots, some time-slots having voltage pulses indicative of data to be applied to the optical cell, or other cells in the array, and other time-slots having no such voltage pulses; the second waveform comprising a sequence of time spaced voltage pulses, each being arranged to coincide with at least part of the waveform having data-carrying portions; the magnitude of the voltage pulses required to switch the optical cell between said stable conditions being subject to different thresholds for different parts of the total area of the optical cell, which thresholds vary with temperature, said data-carrying portion of the first waveform being applied to said first electrode in coincidence with:

a) a first voltage pulse of the second waveform, applied to the second electrode, said first voltage pulse having a first polarity, and a magnitude and duration which ensure that said material assumes said first condition over the whole area of the optical cell irrespective of the data carried by the waveform having data-carrying portions;

b) a second voltage pulse of the second waveform, applied to the second electrode, said second voltage pulse being timed to coincide with one of said voltage pulses indicative of data to be applied to the optical cell, said second voltage pulse having a polarity opposite to said first polarity, and a magnitude and duration which cause a region of the material to switch to said second condition or to remain in said first condition, depending on the data applied to the optical cell; and c) a third voltage pulse of the second waveform, applied to the second electrode; wherein the third voltage pulse is timed to coincide with a portion of the first waveform being applied to the first electrode having data-carrying portions intended for a different cell in the array, and thus having no voltage pulses in the corresponding time slot; and the third voltage pulse has said first polarity, and a magnitude and duration which, at a given temperature and where the aforesaid switching has occurred, cause the material to switch back to the first condition over only a part of any region of the material which was switched into the second condition by said second voltage pulse, whereby the area of the optical cell having material in the first condition and the area of the optical cell having material in the second condition vary less with changing temperature than in the absence of said third pulse.

2. A method according to claim 1, wherein the second voltage pulse has a magnitude and duration which, at a first further temperature different from the given temperature, just ensure that the optical property is switched by the second voltage pulse from the second condition to the first condition over the total area of the optical cell, said data-carrying portion of the waveform being applied to said first electrode in coincidence with:

d) a fourth voltage pulse of the second waveform applied to the second electrode, which pulse is timed to coincide with one of said voltage pulses indicative of data to be applied to the optical cell, said fourth voltage pulse having a polarity opposite to that of the first pulse, and a magnitude and duration which cause a region of the material having been switched back to the first condition by said third voltage pulse to revert to the second condition; and e) a fifth voltage pulse of the second waveform applied to the second electrode, the fifth pulse being timed to coincide with a portion of the waveform being applied to the first electrode having data-carrying portions intended for a different cell in the array, and thus having no voltage pulses in the corresponding time slot, the fifth voltage pulse having said first polarity, and a magnitude and duration which, at said given temperature and where aforesaid switching has occurred, cause the material to switch back to the first condition over only a part of any region of the material which was switched into the second condition by said fourth voltage pulse.

3. A method according to claim 1 in which the material comprises a ferroelectric liquid crystal.

4. A method according to claim 2 in which the material comprises a ferroelectric liquid crystal.

* * * * *